US011155387B2

(12) United States Patent
Cope et al.

(10) Patent No.: US 11,155,387 B2
(45) Date of Patent: Oct. 26, 2021

(54) CONTAINER HAVING A LID CLOSURE LOCK

(71) Applicant: Schoeller Allibert GmbH, Schwerin (DE)

(72) Inventors: Andrew Cope, Essington (GB); Steve Loftus, Pelsall (GB); John Stringer, Walsall (GB)

(73) Assignee: SCHOELLER ALLIBERT GMBH, Schwerin (DE)

( * ) Notice: Subject to any disclaimer, the term of this patent is extended or adjusted under 35 U.S.C. 154(b) by 146 days.

(21) Appl. No.: 16/617,842

(22) PCT Filed: May 30, 2018

(86) PCT No.: PCT/EP2018/064287
§ 371 (c)(1),
(2) Date: Nov. 27, 2019

(87) PCT Pub. No.: WO2018/220073
PCT Pub. Date: Dec. 6, 2018

(65) Prior Publication Data

US 2020/0108982 A1 Apr. 9, 2020

(30) Foreign Application Priority Data

May 30, 2017 (DE) ..... 10 2017 111 753.9

(51) Int. Cl.
*B65D 43/02* (2006.01)
*B65D 19/18* (2006.01)
(Continued)

(52) U.S. Cl.
CPC ..... *B65D 43/0212* (2013.01); *B65D 19/18* (2013.01); *B65D 21/023* (2013.01);
(Continued)

(58) Field of Classification Search
CPC .. B65D 43/22; B65D 43/0212; B65D 43/021; B65D 43/0204; B65D 45/16;
(Continued)

(56) References Cited

U.S. PATENT DOCUMENTS 4,582,219 A 4/1986 Mortensen et al.
5,251,771 A 10/1993 Hotsumi et al.
(Continued)

FOREIGN PATENT DOCUMENTS

CN 1861489 A 11/2006
CN 105600107 A 5/2016
(Continued)

OTHER PUBLICATIONS

Chinese Office Action received in Application No. 201880036709.3 dated Nov. 23, 2020, 5 pages.
(Continued)

*Primary Examiner* — Robert J Hicks

(57) ABSTRACT

A container has an opening that can be closed by a lid and latching elements for releasably locking the lid. The latching elements are arranged in a region of overlap of the container wall and the lid side wall. The latching elements are separately inserted latching elements received in latching-element receptacles, and include latching hooks. The latching hooks can be brought into engagement with inversely corresponding latching-hook receptacles when the container opening is closed by the lid.

9 Claims, 10 Drawing Sheets

(51) Int. Cl.
*B65D 21/02* (2006.01)
*B65D 45/16* (2006.01)

(52) U.S. Cl.
CPC .... *B65D 45/16* (2013.01); *B65D 2519/00706* (2013.01); *B65D 2519/00711* (2013.01); *B65D 2543/00101* (2013.01); *B65D 2543/00296* (2013.01); *B65D 2543/00518* (2013.01); *B65D 2543/00537* (2013.01); *B65D 2543/00574* (2013.01)

(58) Field of Classification Search
CPC ..... B65D 45/22; B65D 19/12; B65D 19/16; B65D 19/18; B65D 19/06; B65D 19/02; B65D 21/023; B65D 21/0222; B65D 21/0223; B65D 21/0219; B65D 21/0215
USPC ..... 220/326, 324, 315; 206/509, 511, 504, 206/600, 386
See application file for complete search history.

(56) References Cited

U.S. PATENT DOCUMENTS 5,862,935 A * 1/1999 Dubois ..... B65D 21/0219 220/281
7,438,198 B2 10/2008 Pickles
2007/0095838 A1 5/2007 Roesler
2007/0235460 A1 10/2007 Killinger et al.
2009/0289066 A1* 11/2009 DiPietro ..... B65D 45/322 220/324
2013/0248399 A1 9/2013 Lin et al.
2016/0046418 A1* 2/2016 Crull ..... B65D 43/02 220/318

FOREIGN PATENT DOCUMENTS

DE 29800733 U1 3/1998
DE 202005007586 U1 8/2005

OTHER PUBLICATIONS

Chinese Search Report received in Application No. 2018800367093 dated Nov. 13, 2020, 2 pages.
German Search Report for German Application No. 10 2017 111 753.9, dated Jan. 9, 2018, 11 pages.
International Preliminary Report on Patentability for International Application No. PCT/EP2018/064287, dated Dec. 3, 2019, 10 pages.
International Search Report and Written Opinion for International Application PCT/EP2018/064287, dated Sep. 11, 2018, 11 pages.

* cited by examiner

CONTAINER HAVING A LID CLOSURE LOCK

CROSS REFERENCE TO RELATED APPLICATIONS

This application is the United States national phase entry of International Application No. PCT/EP2018/064287, filed May 30, 2018, which claims the benefit of priority of German Application No. 10 2017 111 753.9, filed May 30, 2017. The contents of International Application No. PCT/EP2018/064287 and German Application No. 10 2017 111 753.9 are incorporated by reference herein in their entireties.

FIELD

The present invention relates to a container, in particular to a container preferably made of plastic having a lid with which the container can be closed and having a latching element with which the connection between the lid and a peripheral wall of the container can be locked.

BACKGROUND

A container whose lid can be locked using a latching element is known, for example, from DE 20 2005 007 586 U1.

A container according to DE 20 2005 007 586 U1 has a projection protruding outwards at an upper edge of a lower part, said projection interacting in form-fitting manner with an opening at a lower edge of an upper part when the upper part is placed on the lower part to close the container. In order to open the container, pressure is exerted on the projection from outside through the opening in order to push the projection inwards and out of the opening, thus releasing the form-fit between the projection and the opening. The projection is arranged on a tongue, which is defined by a transverse slot and two longitudinal slots running perpendicular to it at the upper edge of the lower part. By means of this tongue, improved mobility of the projection is ensured.

The problem with the container according to DE 20 2005 007 586 U1 is that the repeated pivoting of the tongue for unlocking the lid weakens the connection of the tongue to the lower part of the container and the probability increases that the tongue will break off with prolonged use of the container and that the locking of the container will thus fail.

SUMMARY

The object of the present invention is therefore to provide a container with a latching element for which the probability of a total failure can be reduced in a simpler way.

A container according to the invention has an, in particular essentially rectangular, bottom, a peripheral wall extending upwards from the bottom, a lid, a latching element with a latching hook and a latching-hook receptacle. The peripheral wall is in particular formed by four essentially rectangular side walls and defines a container opening located above the bottom. The lid can be connected to the peripheral wall in such a way that the container opening is closed by the lid. At its edge, the lid has at least one portion which, when the lid is closed, overlaps at least one portion at the edge of the peripheral wall. The at least one, mentioned portion at the lid is called lid-edge overlapping portion in the following. The at least one, mentioned portion at the peripheral wall is called overlapping portion of the peripheral wall edge in the following.

'Overlapping' in this context means that the at least one lid-edge overlapping portion extends directly next to the at least one overlapping portion of the peripheral wall edge. The lid-edge overlapping portion may extend inside or outside of the overlapping portion of the peripheral wall edge.

The container also has at least one latching element provided with a latching hook. The latching element is received in a latching-element receptacle, which is provided at the overlapping portion of the peripheral wall edge or the lid-edge overlapping portion. The latching element is movably connected to the latching-element receptacle. The connection between the latching element and the latching-element receptacle is hereinafter called latching-element linking.

In particular, the latching-element receptacle is formed as a recess in the peripheral wall or in the lid in such a way that the latching element does not protrude or, if applicable, only insignificantly protrudes beyond the regions of the peripheral wall or the lid adjacent to the latching-element receptacle.

If the latching element is located on the overlapping portion of the peripheral wall edge, a latching-hook receptacle is limited on the lid-edge overlapping portion which rests on or borders on this overlapping portion of the peripheral wall edge when the lid is closed.

If the latching element is located at the lid-edge overlapping portion, the latching-hook receptacle is formed correspondingly at the overlapping portion of the peripheral wall edge, which is adjacent to this lid-edge overlapping portion when the lid is closed.

When the lid is closed, the at least one latching-hook receptacle is arranged in a mirror-inverted manner to the at least one latching hook of the at least one latching element in such a way that the latching hook forms a form-fit with the latching-hook receptacle and thus prevents the lid from opening without moving the latching element. Only after moving the latching element and releasing the form-fit of the latching hook with the latching-hook receptacle can the lid be opened. The latching hook and the latching-hook receptacle thus form a locking device for locking the closed lid.

The at least one latching element can be connected in a form-fitting manner to the latching-element receptacle via the latching-element linking. In other words, the latching element can be a separate component attached to the peripheral wall or the lid.

The mobility of the latching element can thus be easily implemented. For example, the latching-element linking can be implemented by means of two bolts which are guided in slotted holes.

The at least one latching element has at least one increased cross-section between its latching hook and its latching-element linking, in particular remote from the latching-element linking.

The latching-element receptacle decreases in size in the direction of the latching hook, at least in sections.

In other words, the latching element tapers in a region between the latching-element linking and the latching hook and also the latching-element receptacle tapers in the direction of the latching hook.

The tapering can be continuous and/or abrupt, i.e. the tapering can be implemented on the outer surfaces of the latching element and on the surfaces of the latching-element receptacle by means of planes, curvatures, projections or steps.

The latching-element linking can be implemented by means of two clips, wherein the clips can each have a base protruding laterally from the latching element, which is connected to a tongue with a laterally protruding bearing pin. Lateral in this context means that the bases or the bearing pins protrude in the plane of the adjacent peripheral wall or in a plane parallel thereto.

At lower ends of side walls of the latching-element receptacle, bearing eyes may be provided which interact in a form-fitting manner with the bearing pins. Side walls of the latching-element receptacle are those walls of the latching-element receptacle which extend transversely, in particular perpendicular, to the adjacent peripheral wall and transversely, in particular perpendicular, to the bottom or to the lid of the container. The lower end of one of the side walls of the latching-element receptacle is understood to be that part of the side wall of the latching-element receptacle which, in comparison to the remaining part of the corresponding side wall of the latching-element receptacle, is further remote from that part of the container which has the latching-hook receptacle corresponding to the at least one latching element. In other words, if the at least one latching-element receptacle is provided on the peripheral wall and the corresponding latching-hook receptacle is provided on the lid, then the lower end of one of the side walls of the latching-element receptacle is the part of the side wall of the latching-element receptacle facing the bottom of the container.

The side walls of the latching-element receptacle may have projections above the bearing recesses which protrude into the latching-element receptacle. The bases of the clips can be shaped in such a way that they are located directly below the projections, so that in case of malfunctions of the connection between the bearing pins and the bearing recesses, the bases interact with the projections in a form-fitting manner. The terms 'above' and 'below' are to be interpreted in this context according to the above definition 'of a lower end of one of the side walls of the latching-element receptacle'.

Due to the form of the latching element and the latching-element receptacle according to the invention, at least parts of the latching element come into contact with parts of the latching-element receptacle if the latching-element linking fails. This form-fit between the latching element and the latching-element receptacle can ensure or at least in sections maintain the locking of the lid if the latching-element linking is broken.

According to one aspect of the invention, the latching-element linking can be movable in such a way that the latching element can be brought into contact with the latching-element receptacle, at least in sections, in addition to the latching-element linking, without releasing or canceling the latching-element linking. In particular, the latching-element linking can be movable in such a way that the base of the clips can also be brought into contact with the projections of the latching-element receptacle, while the latching-element linking is intact.

Basically, the latching element has to meet two requirements. On the one hand, it has to ensure the connection between the lid and the peripheral wall. On the other hand, it has to be movably connected to the lid or peripheral wall in order not to get lost during transport of the container, for example. If the latching-element linking is configured in such a flexible way that the latching element can rest on the latching-element receptacle in addition to the latching-element linking, the two requirements mentioned for the latching element can be met more easily. The latching-element linking essentially only ensures the connection between the latching element and the rest of the container. The actual distribution of force for locking the lid, however, runs through the areas in which the latching element rests on the latching-element receptacle. The actual distribution of force therefore runs through the bases of the clips and the projections of the latching-element receptacle.

According to an alternative aspect, the container, which is made of plastic in particular, can also be distinguished, irrespective of the shape of the latching element and irrespective of the shape of the latching-element receptacle, by the fact that the latching element is formed as a separate component and is attached to the peripheral wall or the lid in a form-fitting manner and can be mounted and/or dismantled without tools.

The multi-piece design of the latching element is advantageous, since if the latching element is damaged, the container can be repaired just by replacing the relevant latching element.

According to one aspect of the invention, the latching-hook receptacle can be formed on a separate component, which is provided at the lid-edge overlapping portion or at the overlapping portion of the peripheral wall edge.

In order to ensure the locking of the lid, under certain circumstances relatively large forces are transmitted at certain points of the latching-hook receptacle. In order not to be forced to manufacture the entire container from one material which can transmit such relatively great forces, a multi-part design can be advantageous and more cost-effective, in which only the part on which the latching-hook receptacle is formed consists of a material designed for concentrated loads.

According to one aspect of the invention, the container may have a spring clip that causes a force acting on the latching element when the lid is unlocked.

In principle, the latching element can be switched between a locking position and an unlocking position. If a spring clip is provided on the container which causes a force on the latching element when the lid is unlocked, the probability of unintentional unlocking can be reduced. The force caused by the spring clip thus acts in the opposite direction to the unlocking direction.

According to one aspect of the invention, the spring clip cannot cause any force acting on the latching element in the locking position of the latching element.

If the spring clip is not pre-tensioned in the locking position, the spring clip is less loaded and can therefore be designed to be less robust and cheaper.

According to one aspect of the invention, the spring clip can be formed integrally with the latching element.

If the spring clip is formed integrally with the latching element, the assembly of the latching element can be simplified.

The assembly of the latching element can be simplified by implementing the latching-element linking by means of two clips. In particular, these clips can be formed integrally with the latching element by providing two flexible tongues on the sides of the latching element, which clamp into the latching-element receptacle. Preferably, projections are provided on the flexible tongues, which can interact with corresponding recesses in the latching-element receptacle. Alternatively, it is also possible to provide projections in the latching-element receptacle that interact with recesses in the flexible tongues.

According to one aspect of the invention, the clips can be provided at the latching element in such a way that they integrally ensure at least one increased cross-section of the latching element.

According to one aspect of the invention, with the lid closed and locked, the latching element can be covered by the at least one lid-edge overlapping portion and/or the at least one overlapping portion of the peripheral wall edge in such a way that only areas of the latching element remote from the latching hook can be accessed from the outside of the container.

By covering the latching hook, it can be protected from external influences, which can prevent damage to the latching hook.

According to an alternative or additional aspect of the invention, the in particular separately designed latching element can be connected to the latching-element receptacle via the latching-element linking in such a way that it is pivoted inwards for unlocking, i.e. towards the inside of the container. Alternatively or additionally, the latching-element linking can also be designed in such a way that the latching element can be shifted inwards.

In other words, the spring clip can be designed so that it pushes the latching element outwards for locking the lid, i.e. towards the outside of the container.

This configuration can be particularly advantageous if the interior of the container according to the invention is under pressure. With increased internal pressure, the latching element is pushed further outwards, which pushes the latching element further into its locking position and reduces the probability of accidental unlocking of the lid caused by the increased internal pressure.

BRIEF DESCRIPTION OF THE DRAWING FIGURES

The present invention is described in further detail in the following based on a preferred exemplary embodiment with reference to the attached drawings, of which:

Identical or functionally equivalent features are provided with the same reference signs in the individual figures.

DETAILED DESCRIPTION

Figure 1:
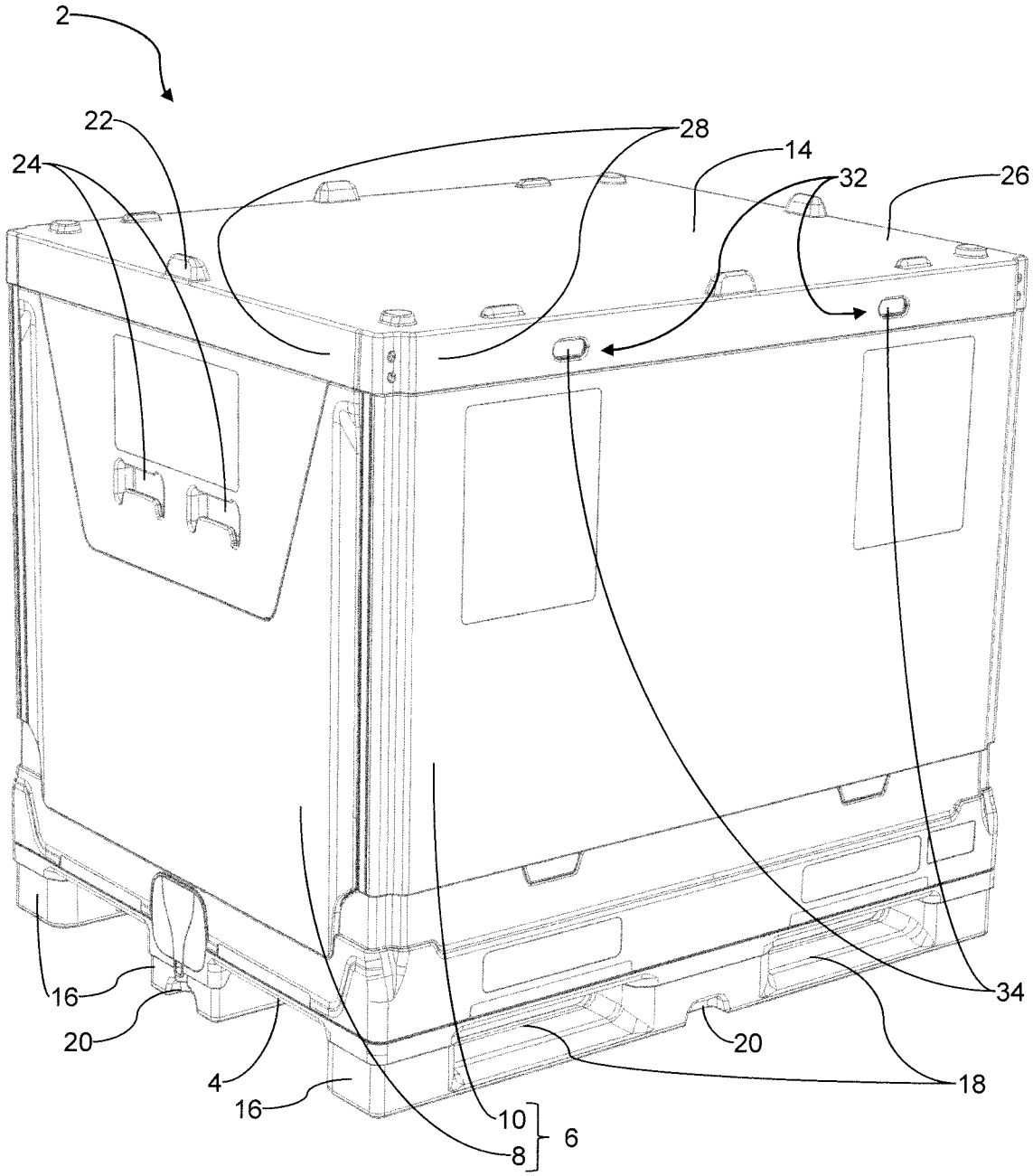
FIG. 1 shows a perspective view of a container according to the invention with a lid.

FIG. 1 shows a perspective view of a container 2 according to the invention, comprising an essentially rectangular bottom 4, a peripheral wall 6 having two short side walls 8 and two long side walls 10 and having or defining a container opening 12 (shown in FIG. 2), and a lid 14.

The bottom 4 has on its underside three runners 16 arranged equidistantly next to each other and extending parallel to the long side walls 10, which are each provided with two openings 18 arranged equidistantly, hereinafter referred to as runner openings 18. Due to the runners 16 or the recesses between the runners 16 and due to the runner openings 18, the container 2 resting on a flat surface can be lifted by an industrial truck, in particular a forklift truck. The shape and also the size of the bottom 4 resemble or correspond in this respect to a pallet, for example a euro-pallet. On the undersides of the runners 16, recesses 20, so-called runner recesses 20, are provided, which can interact in a form-fitting manner with projections 22, so-called lid projections 22, on the upper side of a lid 14 of an identically constructed container 2, so that, if the container 2 is stacked on the identically constructed container 2, the container 2 cannot be pushed sideways from the identically constructed container 2.

Grip recesses 24 are provided on the short side walls 8, which can be used to lift the container 2 manually, especially when empty. Since the short and long side walls 8 and 10 are preferably foldably connected to the bottom 4, the grip recesses 24 are also be used to move the short side walls 8 from a folded position to an upright position. The folding mechanism of the container 2 is irrelevant for the present invention, which is why it is not further explained.

Just like the bottom 4, the lid 14 has an essentially rectangular outline. To be more precise, the lid 14 has an essentially rectangular upper plate 26, hereafter called lid plate 26, at the edges of which frame plates 28 are provided extending in the direction of the peripheral wall 6 when the lid 14 is closed. Since these frame plates overlap with sections 30 of the peripheral wall 6 when the lid 14 is closed, they are hereinafter called lid-edge overlapping portions 28. The sections 30 of the peripheral wall 6, which are overlapped by the lid-edge overlapping portions 28 when the lid 14 is closed and which are located at the upper edge of the peripheral wall 6, which defines the container opening 12, are hereinafter called overlapping portions of the peripheral wall edge 30. When the lid 14 is closed, the lid-edge overlapping portions 28 extend outside the overlapping portions of the peripheral wall edge 30 or enclose them. In order for the lid 14 not to project beyond the peripheral wall 6, or to do so only insignificantly, the overlapping portions of the peripheral wall edge 30 are slightly offset inwards from the remaining portions of the peripheral wall 6 (see FIG. 2). At the lid-edge overlapping portions 30, which are located at the long side walls 10 when the lid 14 is closed, two respective access openings 32 are provided, through which the latching elements 34 provided at the overlapping portions of the peripheral wall edge 30 can be accessed.

Figure 2:
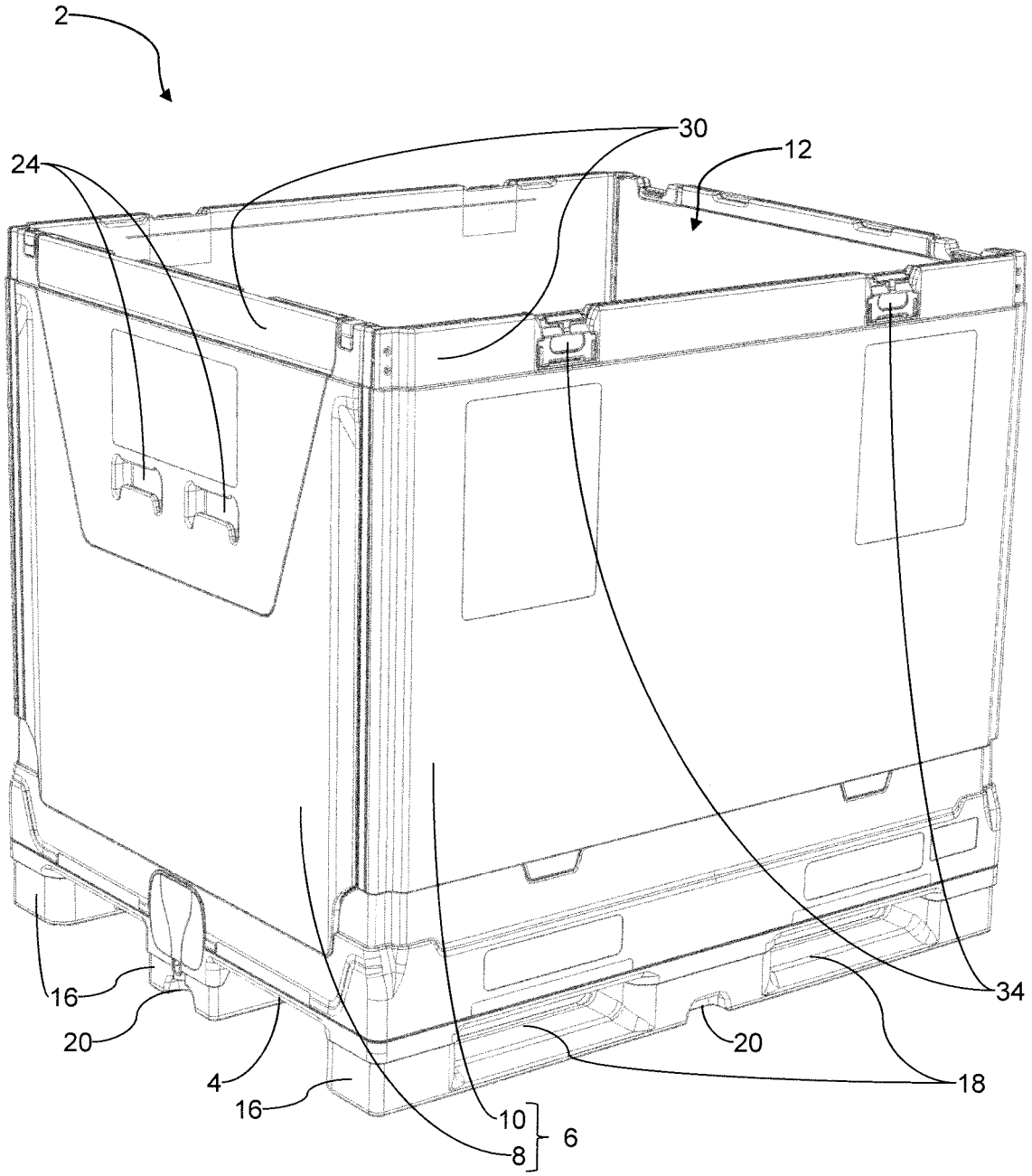
FIG. 2 shows a perspective view of the container of FIG. 1 without the lid.
Figure 3:
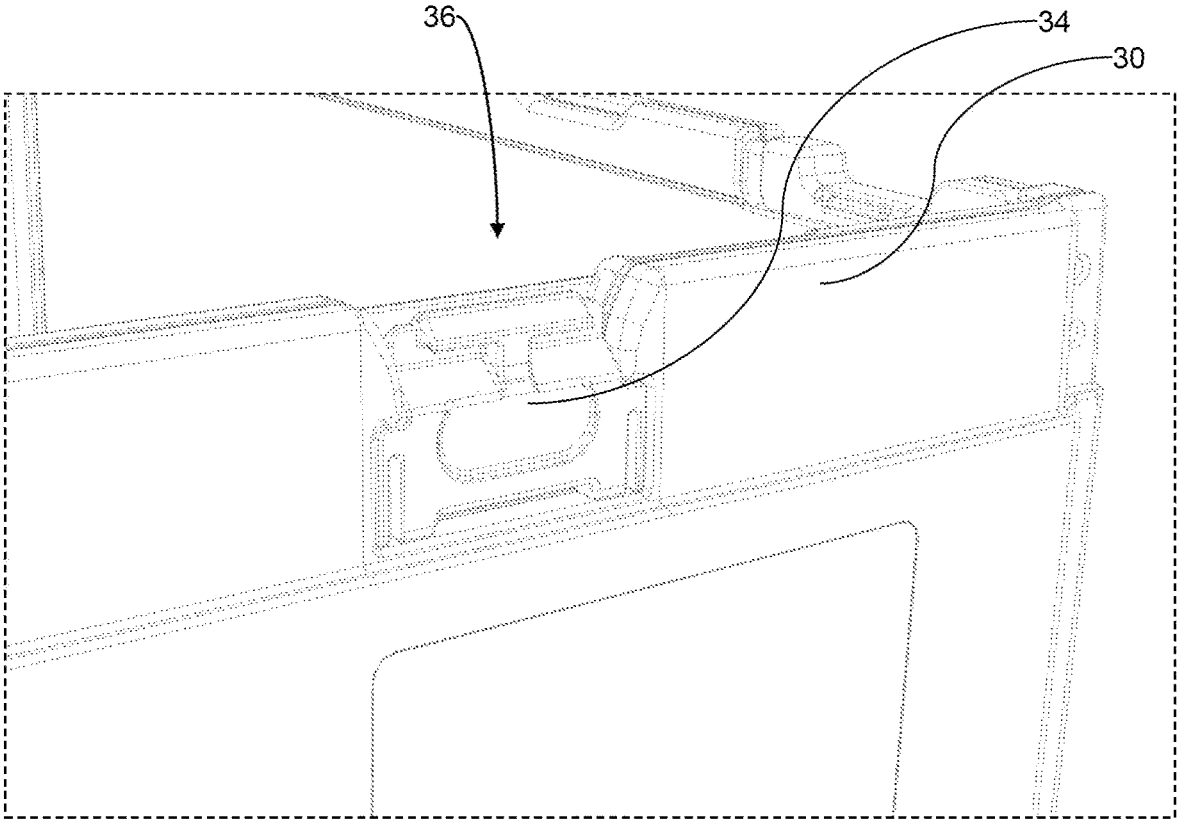
FIG. 3 shows a detailed perspective view of the container of FIG. 2 with a latching element received in a latching-element receptacle.
Figure 4:
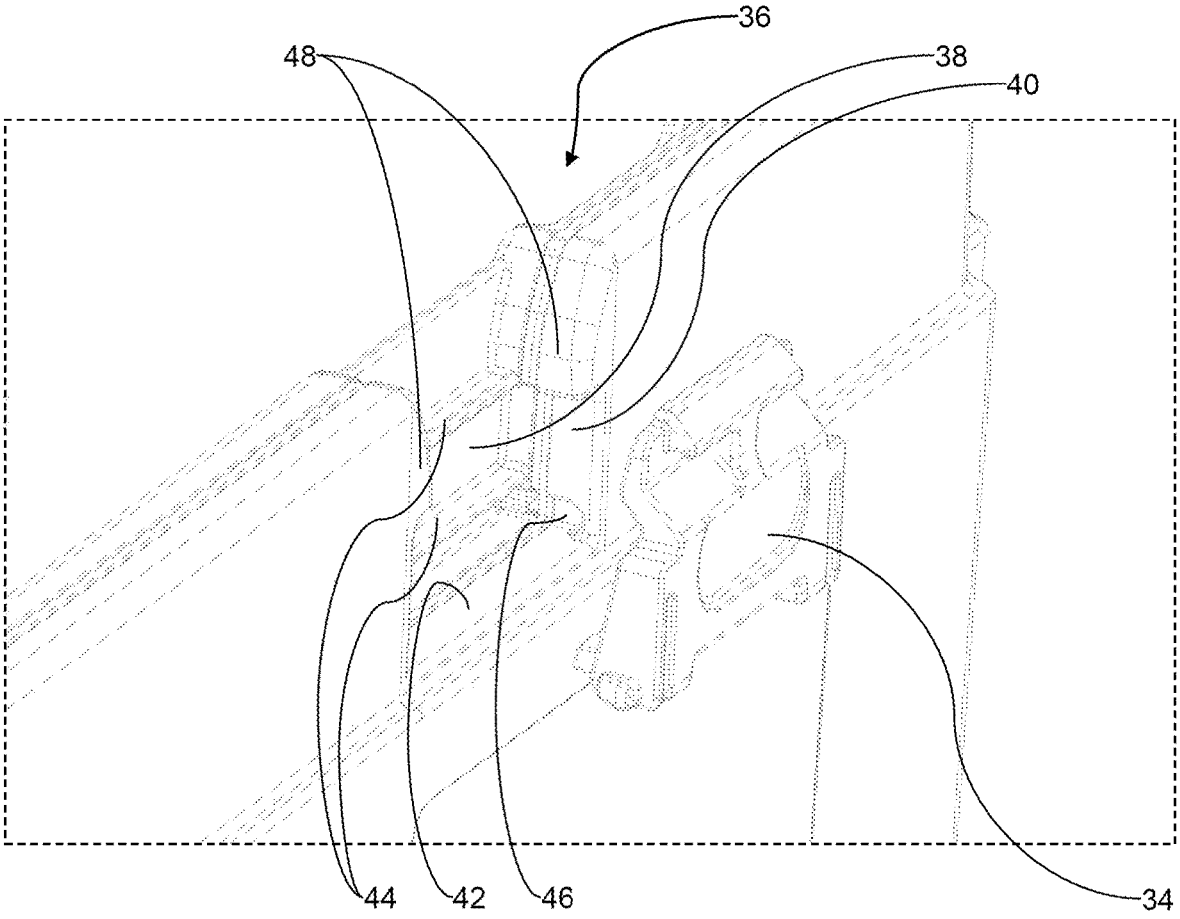
FIG. 4 shows a perspective detail view of the container of FIG. 3 with the latching element shortly before mounting or shortly after dismounting.

As shown in FIG. 2, two latching elements 34 are provided per long side wall 10. As is shown in FIGS. 3 and 4 in more detail, each latching element 34 is received in a recess 36 formed in the corresponding overlapping portion of the peripheral wall edge 30, which is hereinafter called latching-element receptacle 36. As can be seen in the dismantled state of the latching element 34 shown in FIG. 4, the latching-element receptacle 36 extends over the entire height of the overlapping portion of the peripheral wall edge 30, i.e. from the upper edge of the peripheral wall 6 to the edge at which the overlapping portion of the peripheral wall edge 30 is set back with regard to the remaining peripheral wall 6. The latching-element receptacle 36 is essentially a surface set back in parallel from the outside of the peripheral wall 6 in the direction of the inside of the peripheral wall 6. In the area of the latching-element receptacle 36, the peripheral wall 6 is thus much thinner than in the other areas of the peripheral wall 6. The side of the latching-element receptacle 36 running parallel to the adjacent areas of the peripheral wall 6 is hereinafter called receptacle rear wall 38. The transitions from the thin receptacle rear wall 38 to the adjacent, thicker areas of the overlapping portions of the peripheral wall edge 30 are hereinafter called receptacle side walls 40. The transition from the thin receptacle rear wall 38 to the thicker areas of the peripheral wall 6 adjacent to the lower end of the latching-element receptacle 34 is hereinafter called receptacle bottom wall 42. The receptacle rear wall 38 is provided with reinforcement ribs 44 running parallel to the receptacle bottom wall 42. A respective bearing recess 46 is provided at each of the lower ends of the receptacle side walls 40. Above the bearing recesses 46, projections 48 of the receptacle side walls 40 project laterally into the latching-element receptacle 36. The projections 30 are hereinafter called receptacle projections 48 and represent a local cross-sectional reduction of the latching-element receptacle 36.

Figure 5:
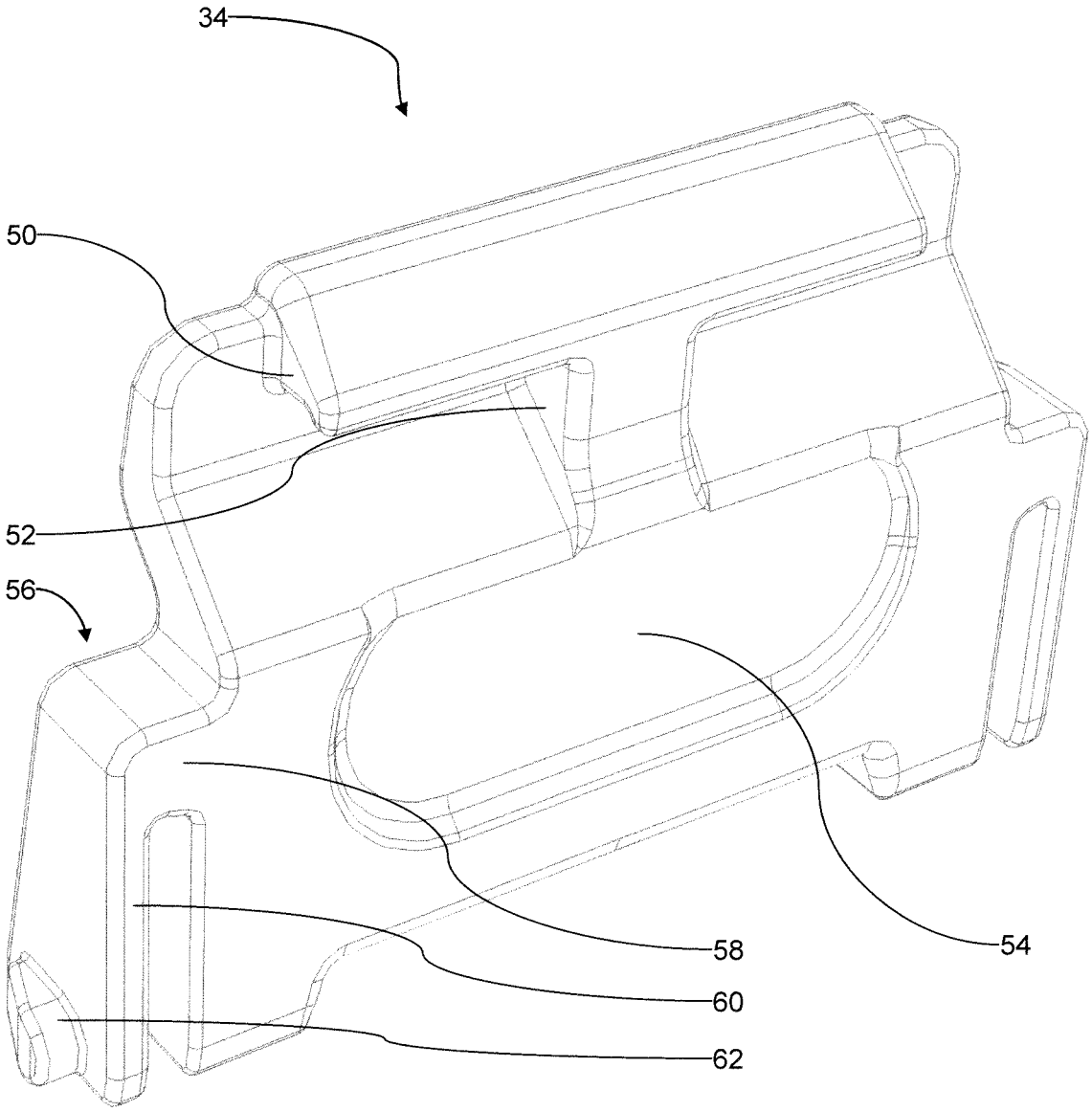
FIG. 5 shows a perspective view of the latching element of FIG. 4 from the front.
Figure 6:
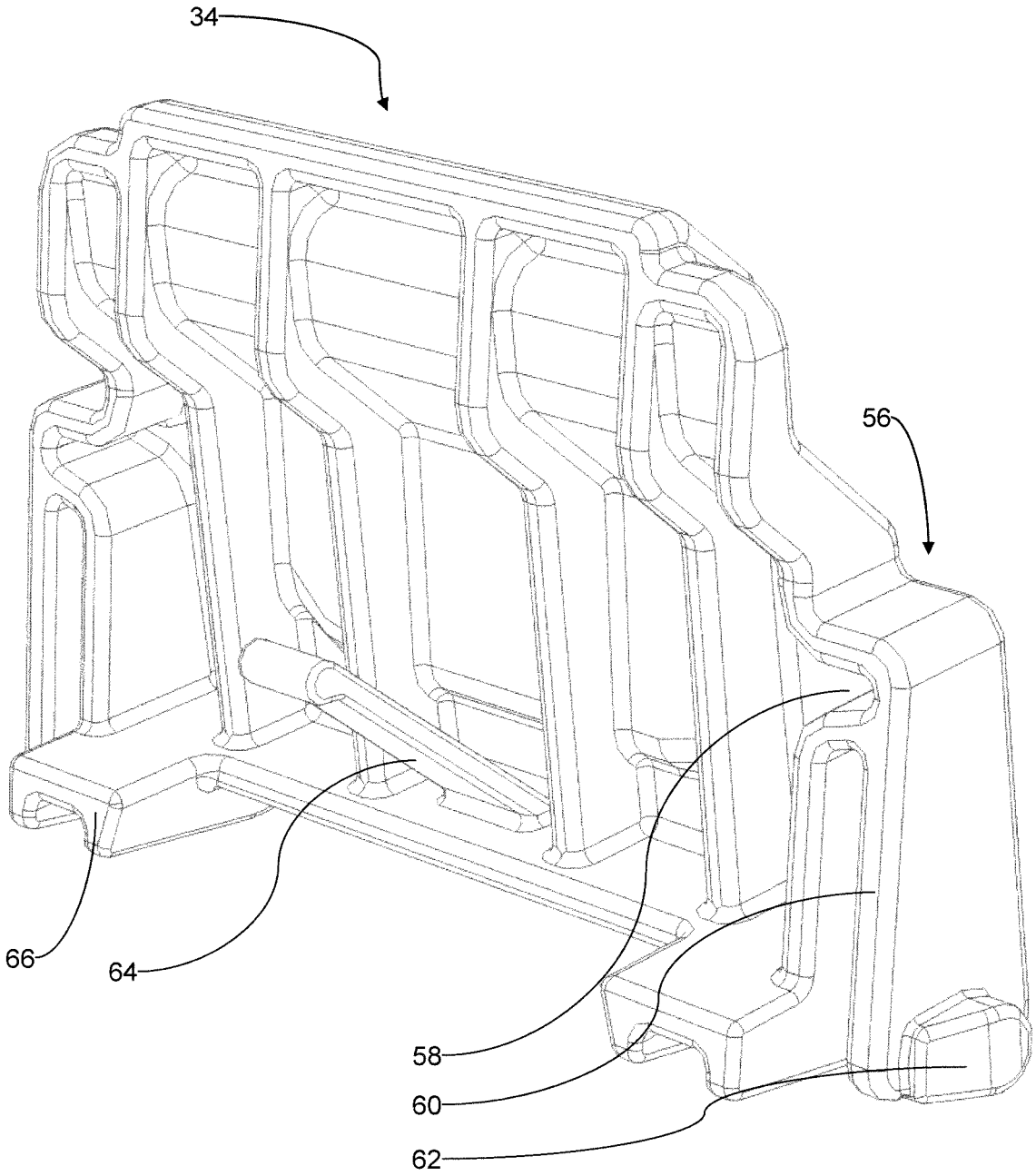
FIG. 6 shows a perspective view of the latching element from FIG. 4 from behind.

The latching element 34 is shown from the front in FIG. 5 and from the rear in FIG. 6. 'Front' refers to the side of the latching element 34 that is visible of the latching element 34 when the latching element 34 is attached to the peripheral wall 6. 'Rear' correspondingly refers to the side opposite the front side of the latching element 34, which is not visible when the latching element 34 is attached to the peripheral wall 6.

At an upper end on the front side, the latching element 34 has a latching hook 50 in the form of a bar projecting to the front. The latching hook 50 is chamfered at the top towards the front, so that the bar essentially has the shape of a wedge. A rib 52 extends downwards from the center of the latching hook 50, which transitions flush at the top into the chamfered surface of the latching hook 50 and flush at the bottom into an actuation surface 54. When the lid 14 is closed, only the actuation surface 54 of the latching element 34 can be touched from the outside via the access openings 32 at the overlapping portions of the peripheral wall edge 30.

The latching element 34 has a respective clip 56 on each side. The clip 56 essentially consists of a bases 58 projecting laterally from the latching element 34, which is followed by a tongue 60 with a laterally protruding bearing pin 62 is connected. The bearing pin 62 is chamfered at its free end.

In order to make the latching element 34 as light as possible, the latching element 34 has different recesses or partitions on its rear side, as shown in FIG. 6. At the bottom in the middle, a spring clip 64 is provided on the rear side of the latching element 34, which is formed in one piece with the latching element 34. The spring clip 65 is essentially beam-shaped and extends upwards to the rear at an angle.

Due to the chamfers at the free ends of the bearing pin 62, the latching element 34 only has to be pressed into the latching-element receptacle 36 for mounting. The chamfers cause the bearing pins 62 to be pressed first in the direction of the actuation surface 54 with elastic deformation of the respective tongue 60. As soon as the latching element 34 has penetrated far enough into the latching-element receptacle 36, the bearing pin 62 can slide in/latch into the corresponding bearing recesses 46 in the latching-element receptacle 36 and the two tongues 60 can relax and thus ensure a tight fit between the bearing pins 62 and the bearing recesses 46. In order to remove the latching element 34, the tongues 60 have to be specially compressed before the latching element 34 can be pulled out of the latching-element receptacle 36.

As shown in FIG. 3, the bases 58 of the clips 56 are shaped in such a way that they are positioned directly below the receptacle projections 48 when the latching element 34 is mounted in the latching-element receptacle 36. If the connection between the bearing pins 62 and the bearing recesses 46 malfunctions during the use of the container 2, a total failure of the latching element can be prevented by a form-fitting interaction of the bases 58 with the receptacle projections 48. Furthermore, the latching element 34 is provided with projections 66 at the bottom of its rear side in such a way that these can also interact with the reinforcement ribs 44 on the receptacle rear wall 38 also in a form-fitting manner in the event of malfunctions in the connection between the bearing pins 62 and the bearing recesses 46.

The position of the latching element 34 shown in FIG. 3 corresponds to a locking position. In this position, the spring clip 64 touches the receptacle rear wall 38 so lightly that the spring clip 64 is not pretensioned. If the latching element 34 is pivoted around its bearing pins 62 in the direction of the receptacle rear wall 38 by pressing the actuation surface 54, the spring clip 64 is tensioned. This position of the latching element 34, which is not shown in the figures, corresponds to an unlocking position.

Figure 7:
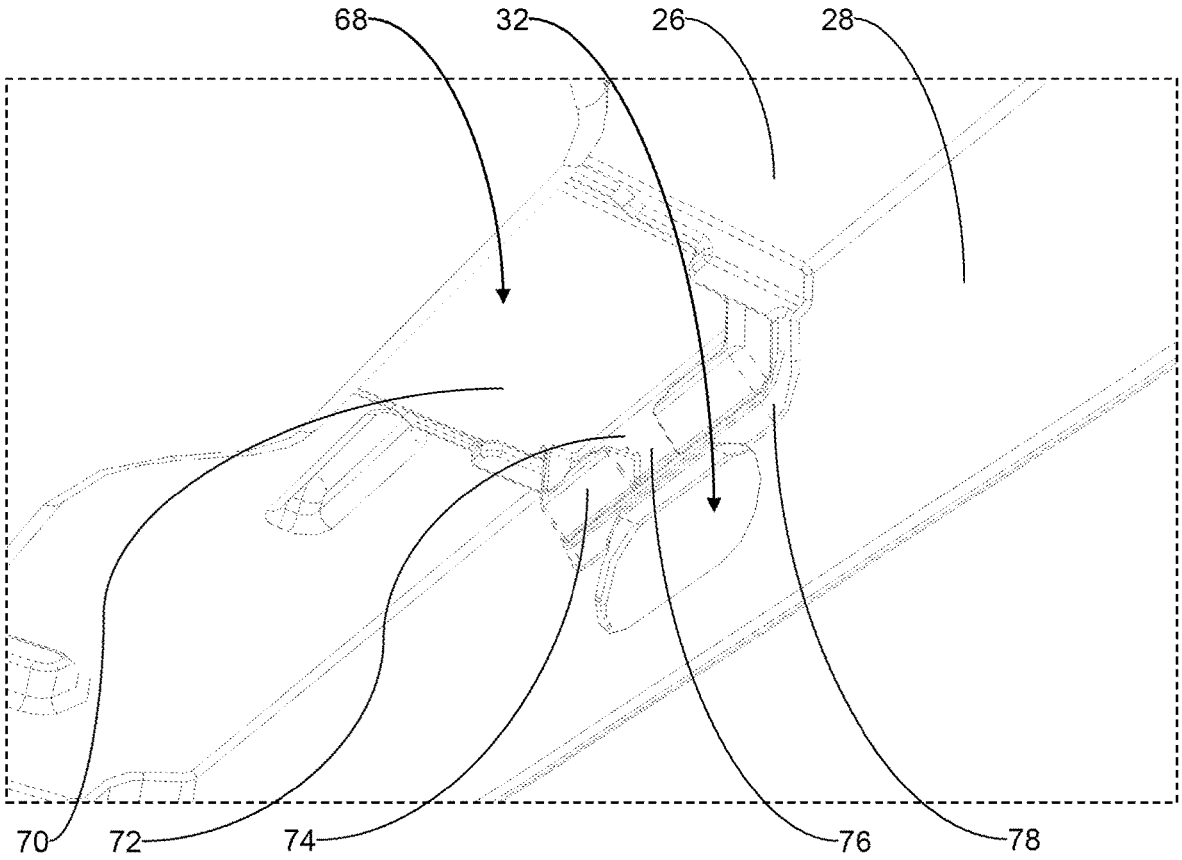
FIG. 7 shows a detailed perspective view of the lid of FIG. 1 from below, so that a latching-hook receptacle is visible.
Figure 8:
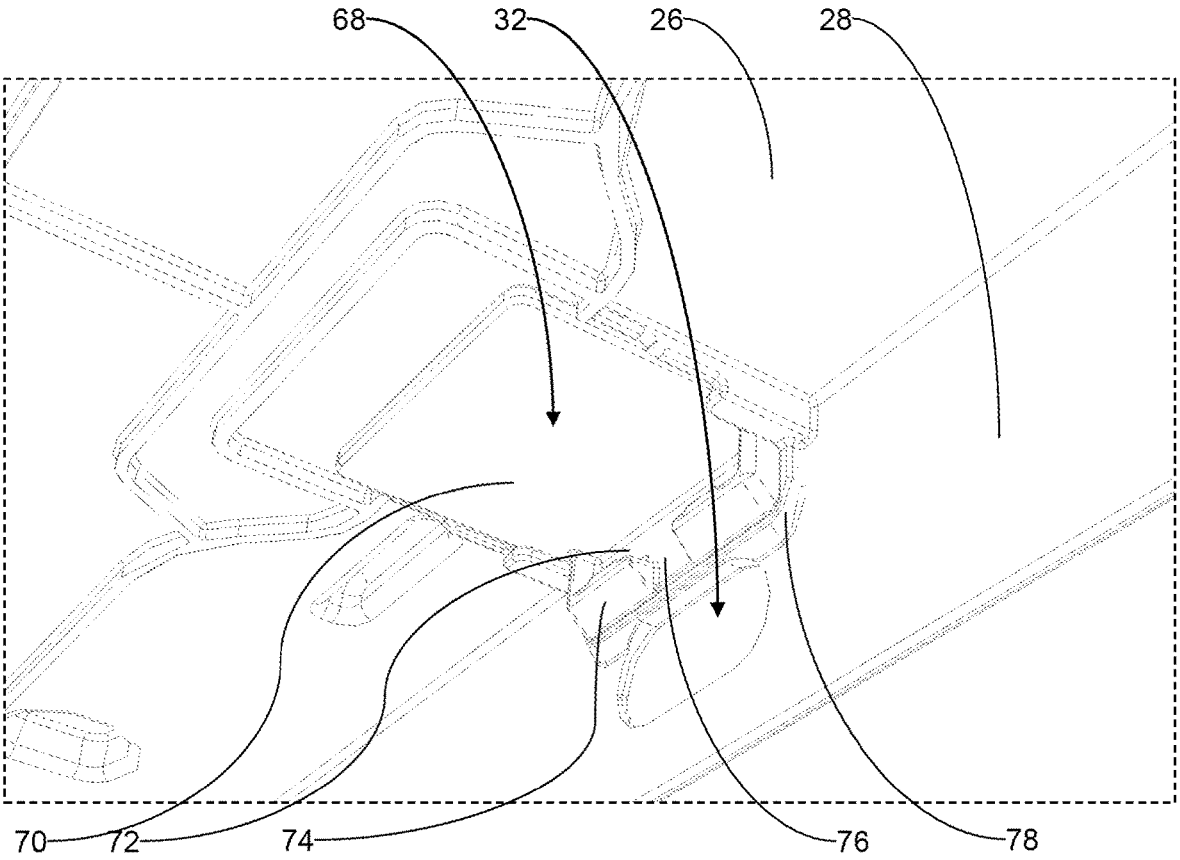
FIG. 8 shows a perspective detail view of the lid of FIG. 7 from below, wherein an inner lid cladding is not shown.
Figure 9:
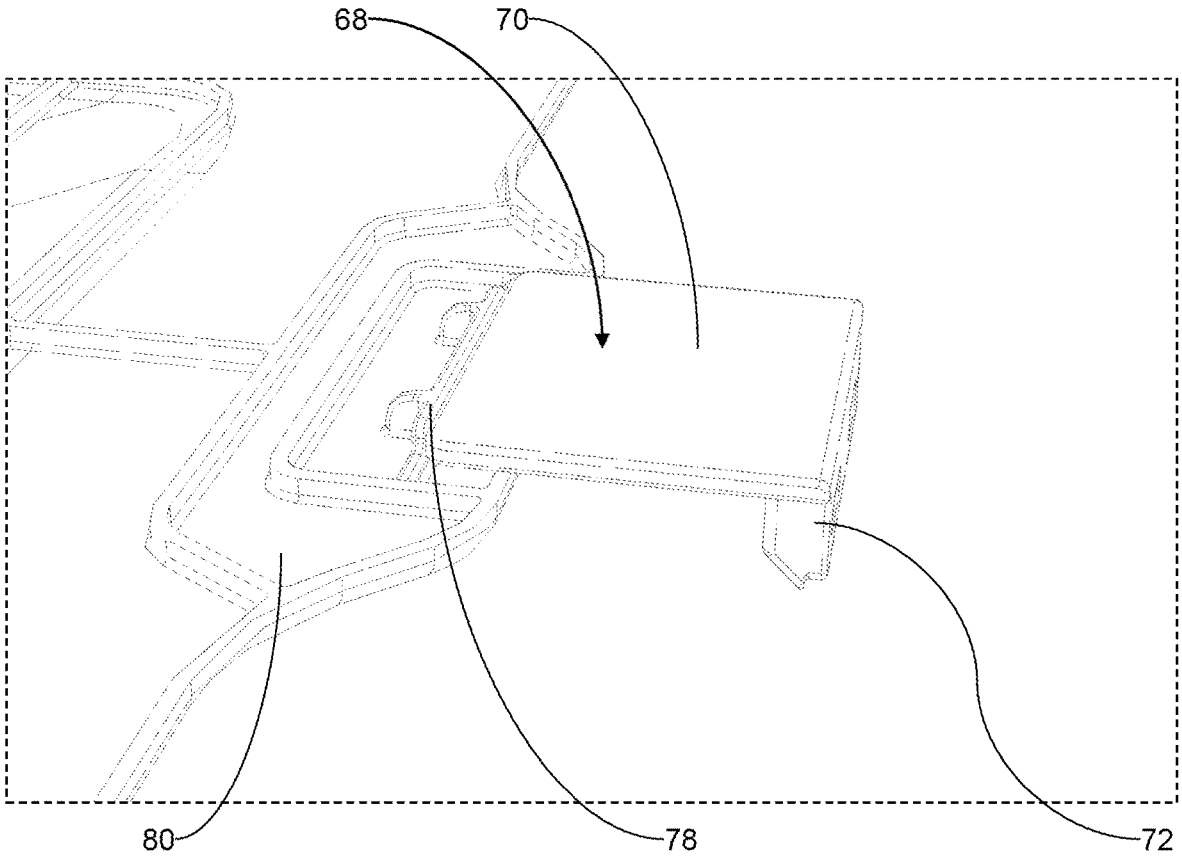
FIG. 9 shows a detailed perspective view of the inner lid cladding not shown in FIG. 8 with the latching-hook receptacle from FIG. 7.

The counterpart to the latching element 34 is the latching-hook receptacle 68 shown in FIGS. 7 to 9, which is designed as a separate component and is attached to the lid 14 in the immediate vicinity of the access opening 32. The latching-hook receptacle 68 is essentially an L-shaped component or an angle. The latching-hook receptacle 68 therefore has two legs. When the latching-hook receptacle 68 is installed, a longer leg 70 extends on the underside of the lid plate 26 and runs parallel to it. When the latching-hook receptacle 68 is installed, a shorter leg 72 extends on an inner side of the lid-edge overlapping portion 28 and runs parallel to it. At the free end of the shorter leg 72, at the access opening 32, a counter hook 74 protruding inwards is provided in the form of a bar protruding inwards. The counter hook 74 is chamfered at the bottom towards the inside, so that the bar, like the latching hook 50, essentially has the shape of a wedge. In its middle, the counter hook 74 has a recess 76 in order to be able to receive the rib 52 of the latching hook 50 in its connected state.

The latching-hook receptacle 68 is connected to the lid 14 in a form-fitting manner. For this purpose, form-fit bars 78 are provided on the inside of the lid 14 on the sides and on the front side of the shorter leg 72 and on the sides of the longer leg 70. In order to fully enclose the latching-hook receptacle 68 and also to fix the front side of the longer leg 70 to the lid 14, a further form-fit bar 78 is provided on an upper side of a lid interior cladding 80. If the lid interior cladding 80 is welded to the underside of the lid plate 26, the lid interior cladding 80 covers the free end of the longer leg 70 and thus holds the latching-hook receptacle 68 in the form-fit bars 78.

If the lid 14 is lowered onto the peripheral wall 6, the interaction of the chamfered surface of the counter hook 74 with the chamfered surface of the latching hook 50 causes the latching element 34 to be pressed in the direction of the receptacle rear wall 38 while deforming the spring clip 64. When the lid 14 is completely closed, the spring clip 64 causes the latching element 34 to swing back into the locking position. In the locking position, the latching hook 50 engages behind the counter hook 74. In order to release the locking, pressure has to be exerted on the latching element 34 via the access opening 32, whereby the latching element 34 is pressed into the unlocking position in the direction of the receptacle rear wall 38.

Figure 10:
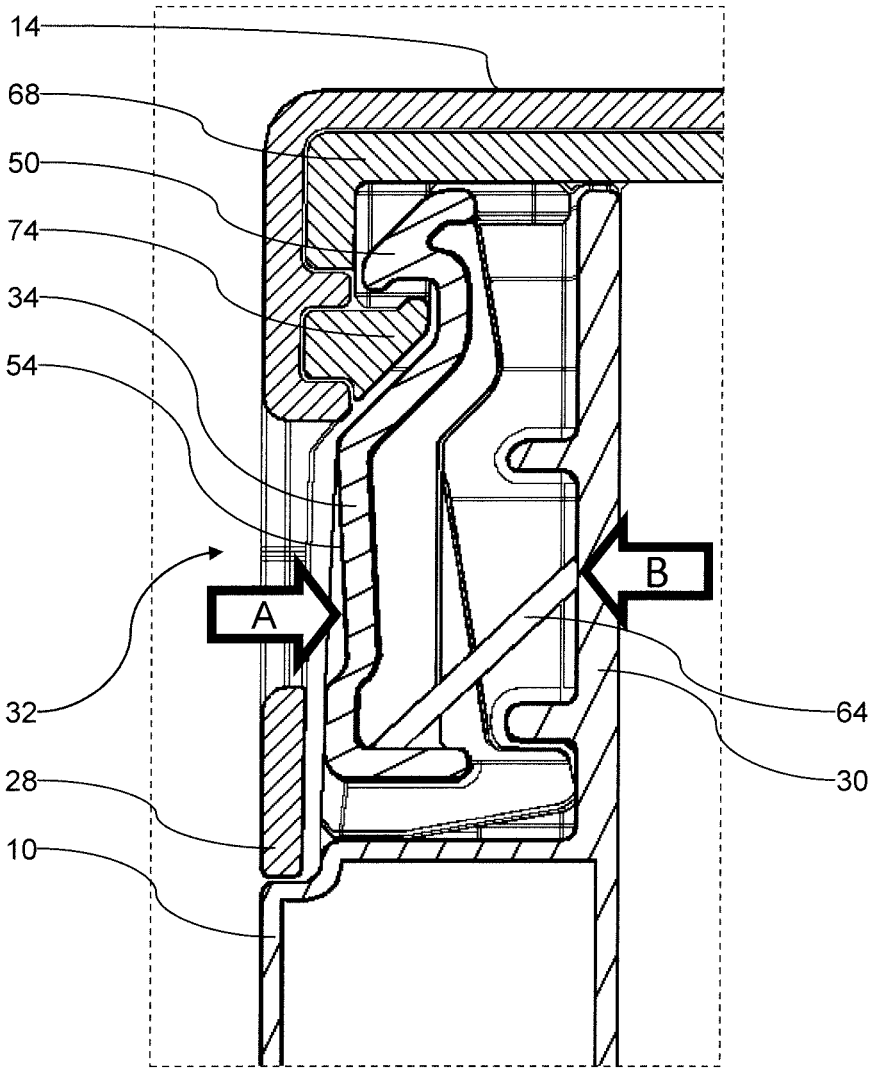
FIG. 10 shows a cross-sectional detail view of the latching element according to the invention in the latched state.

FIG. 10 shows the latching element 34 according to the invention in the state latched with the latching-element receptacle 36 in a cross-sectional detail view. In this state, the latching hook 50 of the latching element 34 and the counter hook 74 of the latching-element receptacle 36 engage with each other. In order to release this engagement, as indicated by the arrow A in FIG. 10, the latching element 34 has to be pressed in the direction of the container interior by manual actuation through the access opening 32. As indicated by the arrow B in FIG. 10, a reaction force is exerted on the spring clip 64, which elastically deforms the spring clip 64. If the latching element 34 is pressed in so far that the latching hook 50 and the counter hook 74 become disengaged, the lid 14 can be lifted, at least at the location of the closure. As soon as the latching element 34 is released, the spring clip 64 causes setting back of the latching element 34 outwards. Due to the wedge shape of the latching hook 50 and of the counter hook 74, latching of the latching element 34 when closing the lid 14 can be achieved without pushing the latching element 34 inwards, simply by lowering the lid 14.

The embodiment of the container 2 according to the invention shown in FIGS. 1 to 9 and described above is merely a possible implementation.

For example, the latching element can also be attached to the lid and the latching-hook receptacle can be attached to the peripheral wall.

The latching element can also be integrally formed with the peripheral wall or the lid. In the same way, the latching-hook receptacle can also be integrally formed with the lid or the peripheral wall.

In the embodiment described, the spring clip is formed integrally with the latching element. Alternatively, it can be designed as a separate component or be formed integrally with the latching-element receptacle.

Instead of the abrupt reduction of the cross-section of the latching-element receptacle in the form of the receptacle projections, it is also possible to implement the reduction of the cross-section by continuously tapering receptacle side walls.

The invention claimed is:

1. A container comprising:

a bottom;

a peripheral wall extending upwards from the bottom and forming a container opening located above the bottom;

a lid which can be connected to the peripheral wall in such a way that the container opening is closed by the lid, and which has at least one lid-edge overlapping portion which overlaps with at least one overlapping portion of a peripheral wall edge when the container opening is closed by the lid;

at least one latching element which is provided with a latching hook and which is received in a latching-element receptacle provided at the overlapping portion of the peripheral wall edge or the lid-edge overlapping portion, and which is movably connected to the latching-element receptacle via a latching-element linking; and at least one latching-hook receptacle, which is formed in a mirror-inverted manner on the lid-edge overlapping portion or the overlapping portion of the peripheral wall edge, which overlaps with the latching element when the container opening is closed by the lid in such a way that the at least one latching hook engages with the at least one latching-hook receptacle and locks the connection between the lid and the peripheral wall, wherein the at least one latching element is connected in a form-fitting manner to the latching-element receptacle via the latching-element linking, wherein the at least one latching element has at least one increased cross-section between its latching hook and its latching-element linking, and the latching-element receptacle of the at least one latching element decreases in size in the direction of the latching hook at least in one portion, wherein the latching-element linking is implemented by means of two clips, wherein the clips each have a base which protrudes laterally from the latching element and which is followed by a tongue with laterally protruding bearing pins, wherein bearing recesses are provided at lower ends of side walls of the latching-element receptacle, which interact in a form-fitting manner with the bearing pins, wherein projections protrude from the side walls of the latching-element receptacle above the bearing recesses into the latching-element receptacle, and wherein the bases of the clips are shaped in such a way that they are located directly below the projections so that, in the event of malfunctions in the connection between the bearing pins and the bearing recesses, the bases interact with the projections in a form-fitting manner.

2. The container according to claim 1, wherein the latching-element linking is designed to be movable in such a way that the latching element can be brought into contact with the latching-element receptacle at least in sections without releasing or canceling the latching-element linking.

3. The container according to claim 1, wherein the latching-hook receptacle is formed on a separate component which is provided on the lid-edge overlapping portion or on the overlapping portion of the peripheral wall edge.

4. The container according to claim 1, further comprising a spring clip which, when the lid is unlocked, causes a force acting on the latching element.

5. The container according to claim 4, wherein the spring clip does not cause a force acting on the latching element in a locking position of the latching element.

6. The container according to claim 4, wherein the spring clip is integrally formed with the latching element.

7. The container according to claim 1, wherein the clips are provided on the latching element in such a way that they integrally ensure the at least one increased cross-section of the latching element.

8. The container according to claim 1, wherein the latching element is covered in sections by the at least one lid-edge overlapping portion and/or the at least one overlapping portion of the peripheral wall edge when the container opening is closed and locked by the lid, in such a way that only regions of the latching element remote from the latching hook can be accessed from the outside of the container.

9. The container according to claim 4, wherein the spring clip presses the latching element in the direction of the outside of the container.

* * * * *